US006267372B1

(12) United States Patent
Mylaeus et al.

(10) Patent No.: US 6,267,372 B1
(45) Date of Patent: Jul. 31, 2001

(54) DEVICE FOR SEPARATING SHEETS IN A PILE

(75) Inventors: Ulrich Mylaeus, München; Kurt Schübel, Planegg; Dirk Müller, München, all of (DE)

(73) Assignee: Giesecke & Devrient GmbH (DE)

( * ) Notice: Subject to any disclaimer, the term of this patent is extended or adjusted under 35 U.S.C. 154(b) by 0 days.

(21) Appl. No.: 09/319,917

(22) PCT Filed: Dec. 19, 1997

(86) PCT No.: PCT/EP97/07206

§ 371 Date: Aug. 30, 1999

§ 102(e) Date: Aug. 30, 1999

(87) PCT Pub. No.: WO98/28212

PCT Pub. Date: Jul. 2, 1998

(30) Foreign Application Priority Data

Dec. 20, 1996 (DE) ..... 196 53 424

(51) Int. Cl.[7] ..... B65H 9/00

(52) U.S. Cl. ..... 271/250; 271/226; 271/236; 271/237

(58) Field of Search ..... 271/236–239, 271/226–234, 237, 250, 251, 10.12, 121

(56) References Cited

U.S. PATENT DOCUMENTS

| | | | | |
|---|---|---|---|---|
| 2,991,073 | | 7/1961 | Relis . | |
| 4,184,673 | * | 1/1980 | Wiesbach | 271/237 |
| 4,236,709 | * | 12/1980 | Hunt | 271/121 X |
| 4,257,587 | * | 3/1981 | Smith | 271/263 |
| 4,362,298 | * | 12/1982 | Stefansson et al. | 271/236 |
| 4,440,389 | * | 4/1984 | Ames et al. | 271/251 |
| 4,483,530 | * | 11/1984 | Spencer et al. | 271/236 |
| 4,930,766 | * | 6/1990 | Garavuso | 271/236 X |
| 5,255,905 | * | 10/1993 | Reid et al. | 271/236 X |
| 5,316,288 | * | 5/1994 | Fish et al. | 271/250 |
| 5,445,371 | * | 8/1995 | Marzullo et al. | 271/121 |
| 5,697,609 | * | 12/1997 | Williams et al. | 271/251 X |

FOREIGN PATENT DOCUMENTS

| | | | |
|---|---|---|---|
| 2151548 | | 4/1972 | (DE) . |
| 0 021 397 A1 | | 1/1981 | (EP) . |
| 0 726 218 A1 | | 8/1996 | (EP) . |
| 06309901 | * | 11/1994 | (JP) . |
| 8201560 | * | 2/1983 | (NL) . |

* cited by examiner

*Primary Examiner*—Christopher P. Ellis
*Assistant Examiner*—Patrick Mackey
(74) *Attorney, Agent, or Firm*—Bacon & Thomas PLLC

(57) ABSTRACT

The apparatus has an input pocket into which a stack of sheets is inserted. At least the sheet to be picked from the stack by the picking device is transported by means of a feed device to a picking device which then picks one sheet from the stack at a time. To improve singling quality, a presingling device is provided which first transports only part of the stack to the picking device. In order to ensure that stacks of different-sized sheet material are singled reliably, an aligning device is provided which transports at least the sheet to be picked from the stack in the direction of a defined stop and thus aligns the sheet against said stop. The aligning device preferably cooperates alternatingly with the feed device. To increase singling reliability, a pressure plate is provided in the presingling device for acting upon the presingled partial stack with a certain pressure.

24 Claims, 4 Drawing Sheets

DEVICE FOR SEPARATING SHEETS IN A PILE

This invention relates to an apparatus for singling sheet material such as bank notes or papers of value from a stack.

Such an apparatus is known for example from DE-OS 21 51 548. The apparatus described therein has an input pocket into which a stack of sheets is inserted. By means of a feed device at least the sheet to be picked from the stack by the picking device is transported to a picking device which then picks a sheet from the stack. To improve singling reliability the apparatus has a presingling device which first transports only a partial quantity of the stack to the picking device.

A disadvantage of the apparatus is that a stack of sheet material with different sizes or formats cannot be singled properly. In order to align one of the longitudinal edges of the sheet material on one side of the stack parallel to the transport direction for example, the operator must joggle the stack on a plane for example before inserting it into the input pocket in order to obtain the desired alignment.

NL-A 8 201 560 discloses a singling apparatus having a feed device and rollers aligned obliquely to the singling direction in order to effect a transverse component toward a lateral bearing surface and thereby align the sheet to be singled. However, as soon as this sheet is grasped by the picking device, this apparatus can no longer align the sheet. This also applies to the singling apparatus known from EP-A 21 397 wherein the sheet to be fed is pushed into the engagement area of two driven conical picking rolls by means of an imbricating roller acting perpendicular to the picking direction.

Starting out from this, the invention is based on the problem of proposing an apparatus for singling sheet material from a stack which reliably singles a stack of sheet material with different formats and different qualities.

This problem is solved by the features of the main claim.

The basic idea of the invention is substantially to provide an aligning device which transports at least the sheet to be picked from the stack by the picking device in the direction of a defined stop so that the sheet is aligned against said stop. The aligning device cooperates alternatingly with a feed device so that the feed device and the aligning device act upon the sheet to be picked from the stack at different times. Said sheet is then transported alternately in the alignment direction and the transport direction until it reaches the picking device.

The advantage of the invention is that each sheet is aligned with an edge parallel to the transport direction independently of its format and is thus located in a defined state for picking.

One preferably provides a presingling device with a pressure device which acts upon a presingled partial stack with a certain pressure. This makes it possible for the sheet to be picked by the picking device to be located in a defined state that does not depend on the number of sheets in the partial stack. Optimizing the picking device to the defined state of the sheet to be picked ensures optimal singling reliability.

Further features of the invention can be found in the independent claims and subclaims. In the following an embodiment of the invention will be described with reference to the figures, in which:

Figure 1:
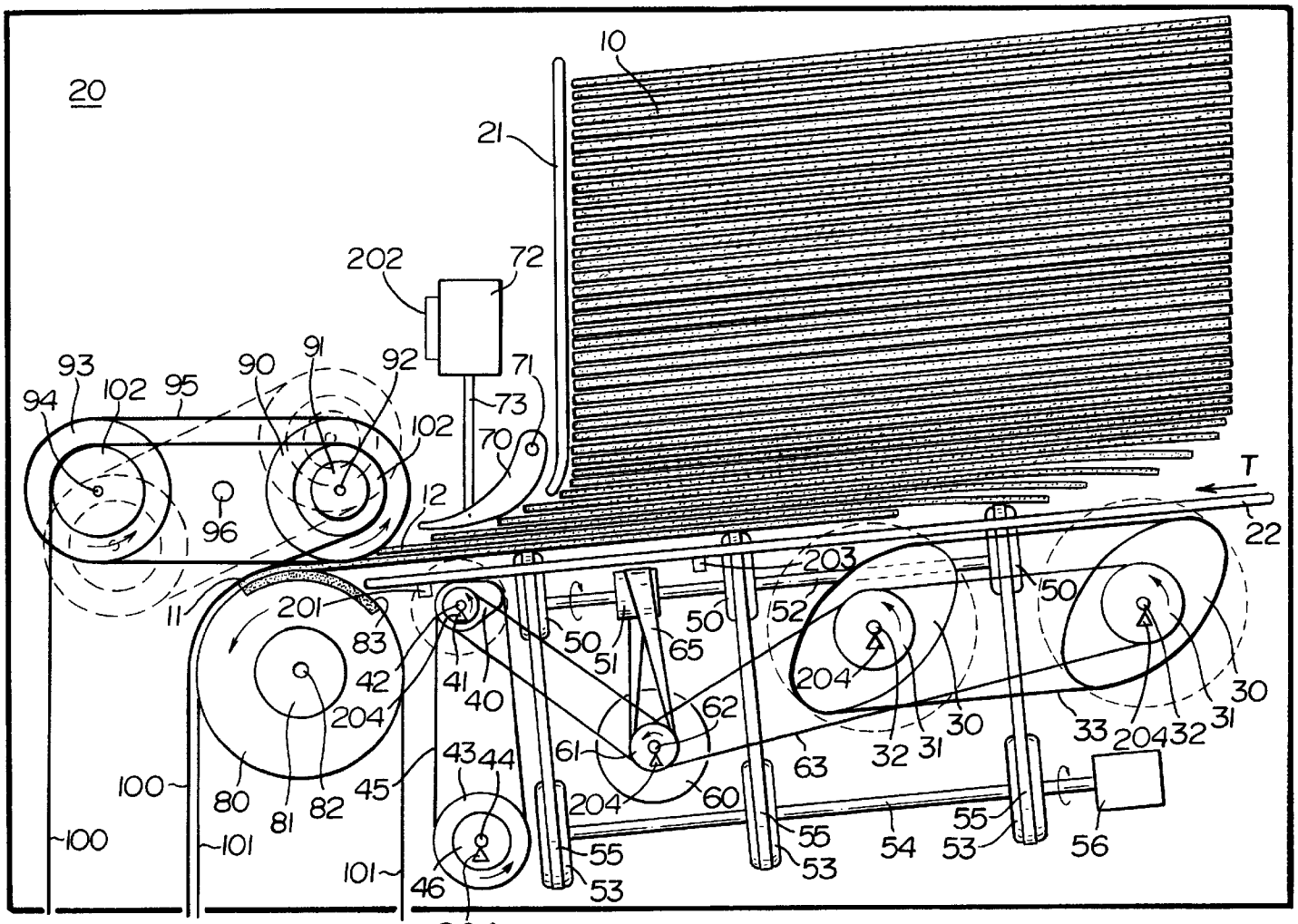
FIG. 1 shows a schematic diagram of a side view of the apparatus.

FIG. 1 shows a side view of an embodiment of the invention. The sheet material is located in stack 10 in an input pocket formed of base plate 20, retaining plate 21 and supporting plate 22.

For transporting the sheets a feed device is provided which can have a plurality of moving elements in frictional contact with the sheet material. The moving elements provided in FIG. 1 are firstly back cam wheels 30 which are disposed together with driving wheels 31 on axle 32. Friction belt 33 is laid around back cam wheels 30. Further, front cam wheel 40 is provided which is analogously disposed with driving wheel 41 on axle 42. At a certain distance from cam wheel 40, mating wheel 43 is disposed on axle 44. Friction belt 45 is laid around cam wheel 40 and mating wheel 43.

The use of friction belts 33 and 45 ensures that a relatively great Frictional surface is available for interaction with the sheet material since friction belts 33 and 45 have a length greater than the circumference of the particular cam wheel. Through the rotation of cam wheels 30 and 40 friction belts 33 and 45 move over the cam wheels so that a different place on friction belt 33 and 45 always interacts with the sheet material. The wear arising through the friction is thus distributed uniformly over friction belts 33 and 45. This achieves a relatively high service life of friction belts 33 and 45 so that they rarely have to be replaced.

In an apparatus singling a relatively small number of sheets in a given time unit and thus having lower wear through abrasion, one can also use cam wheels or differently designed wheels provided only on their circumference at least partly with a frictional element.

Drive 46 serving to drive friction belt 45 can optionally be provided. Cam wheel 40 is designed here so that friction belt 45 can slide over cam wheel 40 independently of the position of the latter. This measure permits the transport speed to be regulated during singling of the sheet material independently of the interaction time of friction belt 45 with the sheet material. The interaction time is determined substantially by the rotational speed of cam wheel 40.

In order to reduce the wear of friction belts 33 and 45 further, cam wheels 30 and 40 can be at least partly spring-mounted 204. This permits the pressure of friction belts 33 and 45 against the sheet material to be limited upward.

The limitation of pressure is effective in particular with high stacks 10. This limitation of pressure prevents excessive feed forces with high stacks 10 which can lead to increased double picks. Furthermore, friction belts 33 and 45 can give way when touched by the user, which reduces the danger of injury.

Back cam wheels 30 are preferably executed with an elliptical outside contour. Friction belt 33 laid over two elliptical cam wheels 30 has the same length in every position of cam wheels 30. One can thus obtain a relatively great pitch of the cams without changing the length of friction belt 33.

Further, an aligning device is provided. It has a plurality of moving elements in frictional contact with the sheet, for example in the form of cam wheels 50 disposed with driving wheel 51 on axle 52. Analogously to mating wheel 43 of front cam wheel 40, a corresponding number of mating wheels 53 are disposed on axle 54 at a certain distance from cam wheels 50 here too. Friction belt 55 is laid around each cam wheel 50 and mating wheel 53. Here too, axle 54 and thus also friction belts 55 can optionally be driven by drive 56.

Cam wheels 30, 40 and 50 are preferably driven by single cam wheel drive 60. Cam wheel drive 60 drives driving wheel 61 disposed on axle 62. Cam wheels 30, 40 and 50 are driven by means of drive belts 63, 64 and 65 via corresponding driving wheels 31, 41 and 51.

The form of cam wheels 30, 40 and 50 is selected so that their cams protrude a certain amount through supporting plate 22 into the input pocket so that friction belts 33, 45 and 55 come in contact at least with sheet 11 to be picked from stack 10.

Driving wheels 31, 41 and 51 of cam wheels 30, 40 and 50 are dimensioned so that firstly the cams of cam wheels 30 and 40 and secondly the cams of cam wheels 50 pass through supporting plate 22 simultaneously. The cams of cam wheels 30 and 40 preferably pass through supporting plate 22 with a constant phase shift in time relative to the cams of cam wheels 50 so that the cams of cam wheels 30 and 40 of the feed device and the cams of cam wheels 50 of the aligning device act alternatingly at least upon sheet 11 to be picked from stack 10.

As an alternative to cam wheels 30, 40 and 50 one can also use round wheels which pass through supporting plate 22 analogously by means of a suitable mechanism. Here, too, one should preferably make sure that the wheels of the feed device and the wheels of the aligning device act alternatingly at least upon sheet 11 to be picked from stack 10.

Figure 2:
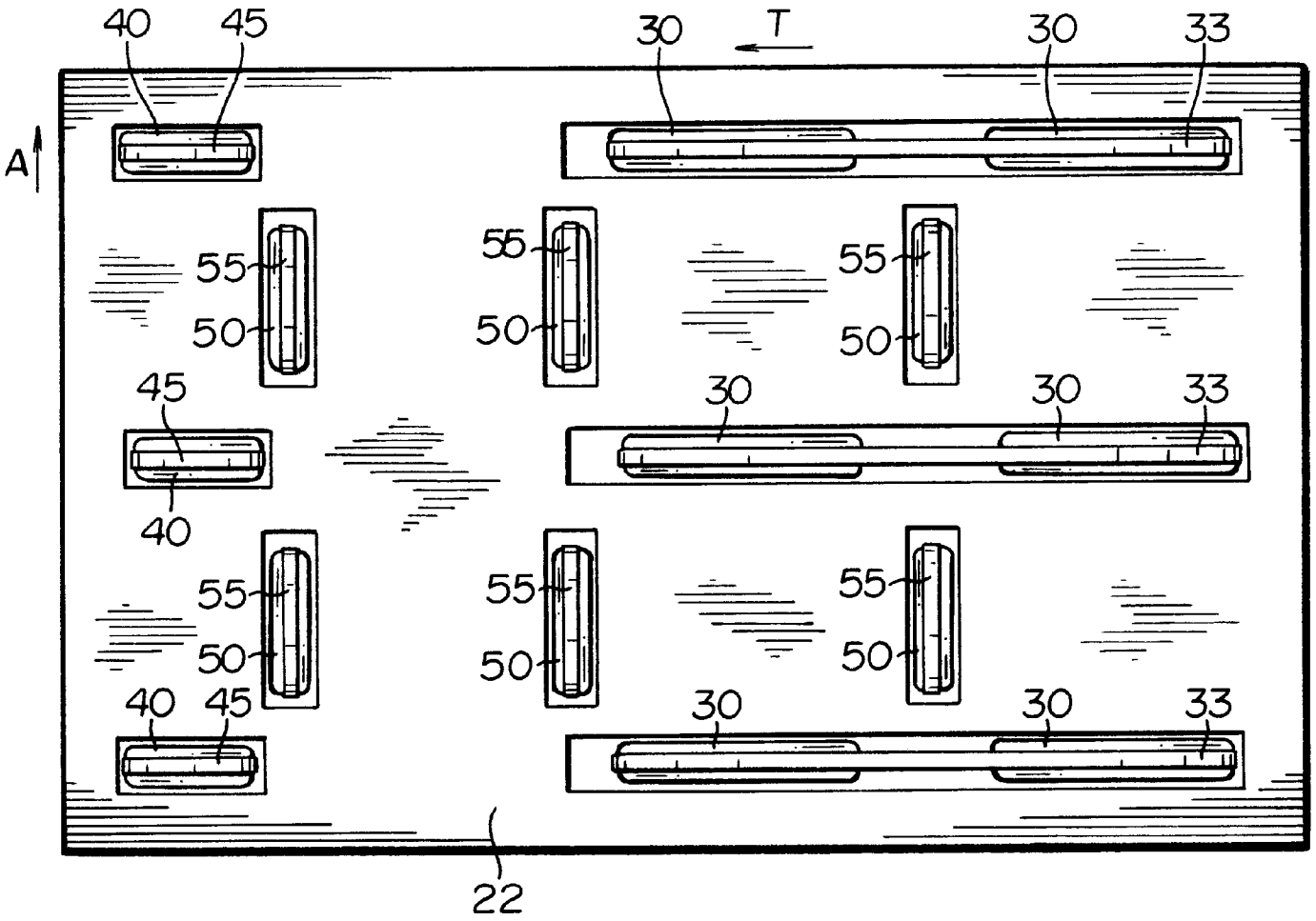
FIG. 2 shows a first possibility of arranging feed device and aligning device.

FIG. 2 is a schematic diagram of a plan view of supporting plate 22 through which the cams of cam wheels 30, 40 and 50 preferably pass alternatingly. Cam wheels 30 and 40 of the feed device are aligned parallel to transport direction T. Cam wheels 50 are disposed parallel to alignment direction A.

Through the action of friction belts 33 and 45 laid around cam wheels 30 and 40 upon passage of the cams through supporting plate 22, at least sheet 11 to be picked from stack 10 is first transported a certain distance in the transport direction. The cams of cam wheels 30 and 40 then pass through supporting plate 22 again so that friction belts 33 and 45 no longer interact with sheet 11. Parallel thereto the cams of cam wheels 50 pass through supporting plate 22 so that friction belts 55 act at least upon sheet 11 of stack 10 and transport it in the direction of a defined stop which is formed here by base plate 20.

By suitably dimensioning cam wheels 50 and their rotational speed one can ensure that at least sheet 11 to be picked is aligned with an edge parallel to transport direction T on base plate 20 before the sheet is picked from stack 10 by a picking device.

Figure 3:
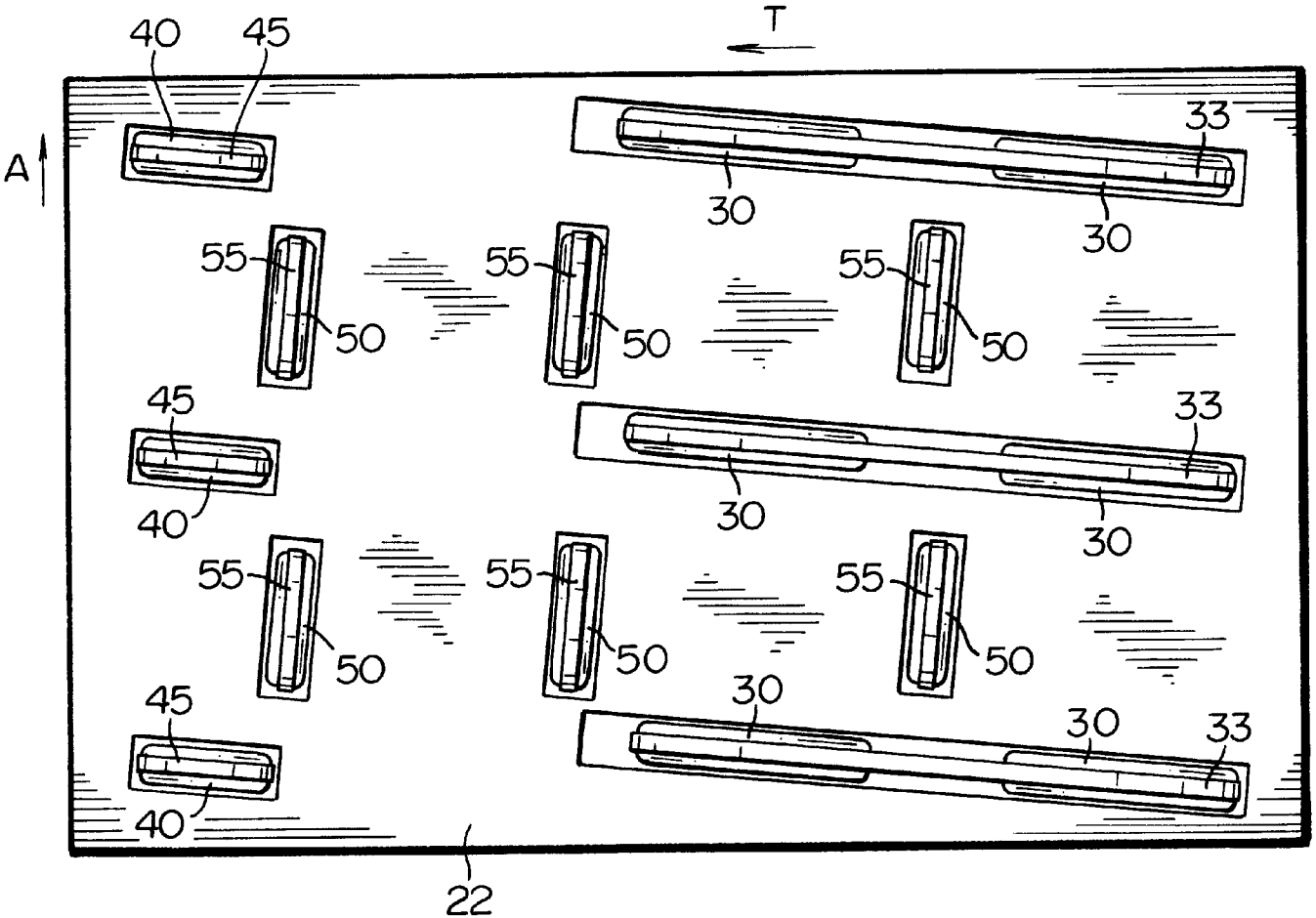
FIG. 3 shows a second possibility of arranging feed device and aligning device.

FIG. 3 shows a second possibility of arranging cam wheels 30, 40 and 50 whereby cam wheels 30 and 40 of the feed device are shifted by a certain angle to transport direction T so that sheet 11 to be picked is transported not only in transport direction T but also in alignment direction A. The advantage of this is that sheet material 11 is aligned more quickly against base plate 20 since all cam wheels 30, 40 and 50 effect a certain transport of sheet 11 in the direction of base plate 20.

Additionally, cam wheels 50 of the aligning device are disposed rotated by a certain angle so that sheet 11 to be picked is not only transported in the alignment direction but also acted upon with a component directed backwards relative to the transport direction. The advantage of this is that the sheets are withdrawn from the picking device in the case of a jam before or in the picking device. The jam can thus normally be eliminated automatically, which again increases singling reliability.

To increase singling reliability further, the apparatus has a presingling device which is shown in FIG. 1 and has a pressure device besides retaining plate 21. Said pressure device consists of pressure element 70 pivoted around axle 71. Pressure element 70 can be moved by means of drive 72 and rod system 73. Drive 72 can be executed for example as a spring or an electrically drivable stepping motor or as a combination of the two.

In order to reduce the frictional resistance between the partial stack and pressure element 70, pressure element 70 can be formed in a rocker shape or consist directly of rockers. When pressing against the partial stack, only the rockers enter into interaction with the partial stack.

For presingling, retaining plate 21 bracing the stack is dimensioned so that between retaining plate 21 and supporting plate 22 there is a gap through which only a partial stack with a limited number of sheets can be transported. The position of pressure element 70 is controlled so that it acts upon the partial stack passing through the gap with a certain pressure. The pressure is preferably selected greater than the pressure acting upon the feed or picking device through the weight of the partial stack. This permits sheet 11 to be singled to be loaded with an approximately constant pressure which is substantially independent of the number of sheets in the partial stack. Sheet material 11 to be singled is thus located in a defined state which is not dependent on the number of sheets in the partial stack. The picking device can be adapted optimally to said defined state.

As an alternative to pressure plate 70 one can also provide means 202 in the presingling device which produce a constant air stream. This air stream is guided so that it acts upon the partial stack with a constant pressure. If required, these means 202 for producing a constant air stream can also be combined with pressure element 70 with or without rockers.

Sheet 11 to be picked., when aligned and acted upon with certain pressure, is picked from stack 10 by a picking device. Said device has singling roll 80 driven by drive 81 via axle 82. Drive 81 used is preferably a stepping motor which accelerates singling roll 80 for picking a sheet from the inoperative position to the desired picking speed. Singling roll 80 has frictional elements 83 for picking sheet 11 to be picked from stack 10.

Drive 81 is controlled by control means not shown here. In a first operating mode, drive 81 is controlled by the control means in constant time intervals so that one sheet at a time is picked from stack 10 by singling roll 80 in constant time intervals.

However, in the area of the picking device one preferably provides sensors 201 whose measured values are evaluated for controlling the stepping motor. In a second operating mode, a sensor 201 detects the leading and/or trailing edges of sheet 11 after singling. The singling of following sheet 12 is effected with a constant delay after detection of the trailing edge of sheet 11 to be picked. This results in a gap of constant size between sheet 11 to be picked and following sheet 12. This operating mode is especially advantageous for singling sheet material of different sizes since the throughput of the sheets can thus be optimized.

The circumference of singling roll 80 is preferably selected so that it is equal to the sum of the length of the shortest sheet to be picked and a system-induced minimal gap. This ensures that even the shortest sheets to be picked can be optimally singled.

To avoid double picks the picking device has a retaining device. According to the embodiment in FIG. 1 the latter has retaining roll 90 driven by drive 91 via axle 92. Friction belt 95 is laid over mating wheel 93 mounted on axle 94 and around retaining roll 90. One can likewise use differently designed retaining devices such as stationary retaining blocks or frictional wheels.

For singling the sheet material, drive 91 drives retaining roll 90 in controlled fashion so that friction belt 95 is moved opposite to transport direction T. The frictional effect of frictional element 83 and friction belt 95 is selected so that the frictional effect of frictional element 83 is greater than that of friction belt 95. Both frictional effects are greater than the frictional effect between two sheets 11 and 12. This ensures that only sheet 11 to be picked is grasped by frictional element 83 of singling roll 80. Following sheet 12 is retained by friction belt 95 of the retaining device.

To eliminate disturbances it is also possible in case of need to drive retaining roll 90 in controlled fashion so that friction belt 95 transports the sheet material in transport direction T. This can be advantageous in particular for dissolving jams in the area of singling roll 80.

The retaining device is pivoted around pivot 96 so that the distance between the retaining device and singling roll 80 varies upon rotation of the retaining device around pivot 96. The position of the rotated retaining device is shown by dash lines in FIG. 1. The retaining device is preferably lockable in this position so that one has easy access to the sheet material if e.g. a sheet jam cannot be eliminated automatically.

In order to minimize the wear of friction belt 95, the length of the friction belt is again selected greater than the circumference of retaining roll 90. To limit the pressure of friction belt 95 upward, the retaining device is preferably spring-mounted.

One can optionally provide a sensor which detects the position of the retaining device. In accordance with the detected position the operativeness of the apparatus, for example, can be signaled by the control means.

Figure 4:
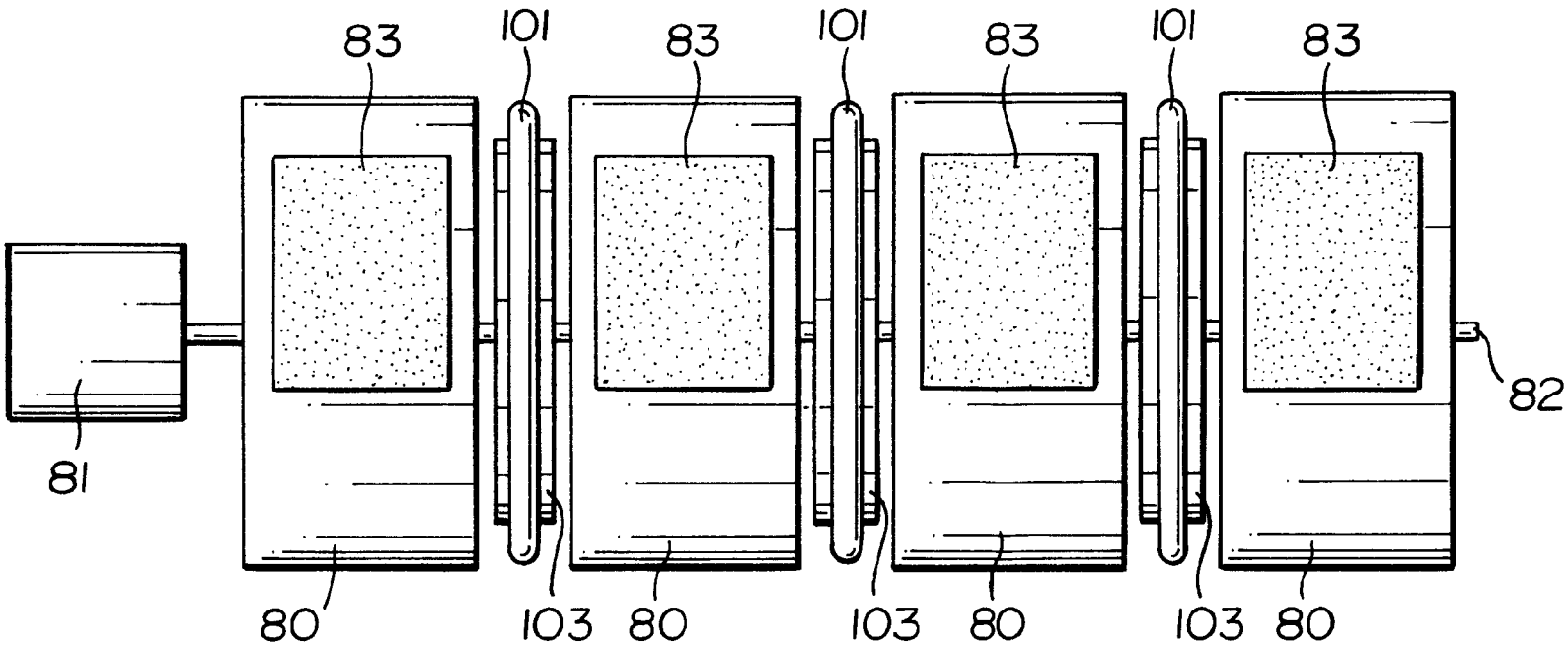
FIG. 4 shows a schematic diagram of a plan view of the singling roll.

Sheet material 11 picked from stack 10 can then be transported by a transport system to processing devices for example. The transport system here has transport belts 100 and 101 between which the sheet material picked from stack 10 is transported. Transport belts 100 are deflected around live wheels 102 mounted on axles 92 and 94 of the retaining device. To deflect transport belts 101 singling roll 80 has on axle 82 free-running live wheels 103, as shown in FIG. 4, over which transport belts 101 are deflected. If required, such free-running live wheels can also be provided in retaining roll 90 and in mating wheel 93.

Optionally one can provide in the input pocket a sensor 203 (not shown here) which detects the presence of sheet material. The measured values detected by the sensor 203 can be used for example for controlling the drive of singling roll 80 and for controlling drive 60.

What is claimed is:

1. An apparatus for singling sheet material from a stack (10) comprising:

an input pocket (20–22) for the stack, a picking device (80–83, 90–95) arranged to pick one sheet (11) from the stack (10) at a time, a feed device (30, 33, 40–43) arranged to transport at least one sheet of the stack in the direction of the picking device, an aligning device (50–55) provided within the input pocket (20–22) and being separate from said feed device, said aligning device being arranged to transport at least the sheet to be picked by the picking device in the direction of at least one defined stop (20) so that the sheet is aligned against said stop, said feed device and said aligning device operating independently in an alternating sequence at least upon the sheet to be picked from the stack by the picking device.

2. An apparatus according to claim 1, wherein the feed device (30, 33, 40–45) is arranged so that it transports the sheet (11) to be picked from the stack (10) by the picking device additionally in the direction of the stop (20).

3. An apparatus according to claim 1, wherein the aligning device (50–55) is arranged so that it acts upon the sheet to be picked from the stack by the picking device additionally with a component directed backwards relative to the transport direction (T) of the sheet.

4. An apparatus according to claim 1, wherein the feed device (30, 33, 40–45) and the aligning device (50–55) are arranged so that they act with a constant phase shift at least upon the sheet to be picked from the stack by the picking device (80–83, 90–95).

5. An apparatus according to claim 1, wherein the feed device (30, 33, 40–45) and the aligning device (50–55) comprise moving elements (33, 55) in frictional contact with the sheet.

6. An apparatus according to claim 5, wherein the moving elements (33, 45) of the feed device are disposed parallel to the transport direction (T).

7. An apparatus according to claim 5, wherein the moving elements (33, 45) of the feed device are disposed at a predetermined angle between transport direction (T) and alignment direction (A).

8. An apparatus according to claim 5, wherein the moving elements (55) of the aligning device are disposed parallel to the alignment direction (A).

9. An apparatus according to claim 5, wherein the moving elements (55) of the aligning device are disposed at a predetermined angle between alignment direction (A) and an opposite transport direction.

10. An apparatus according to claim 5, including a drive (60) and wherein the moving elements (33,55) are driven by means of said drive (60).

11. An apparatus according to claim 5, wherein the moving elements are at least partly spring-mounted.

12. An apparatus according to claim 5, wherein the moving elements comprise at least partly friction belts running around deflection rollers (30, 50, 53) and having a length greater than the circumference of the deflection rollers.

13. An apparatus according to claim 12, wherein the deflection rollers are cam wheels (30, 50, 53) with an elliptical outside contour.

14. An apparatus according to claim 1, including a presingling device (70–73) with a pressure device (70) arranged so that it acts upon a presingled part of the stack with a preselected pressure disposed before the picking device in the transport direction.

15. An apparatus according to claim 14, wherein the pressure device comprises a springy pressure plate (70).

16. An apparatus according to claim 15, wherein the pressure plate (70) includes rockers.

17. An apparatus according to claim 14, wherein the presingling device (70–73) comprises a constant air stream supplier arranged so that it acts upon the partial stack with a constant pressure.

18. An apparatus according to claim 14, wherein the preselected pressure is greater than the pressure produced by the weight of a partial stack with the maximum number of sheets.

19. An apparatus according to claim 1, including a sensor in an area near the picking device arranged to sense the leading edge and trailing edge of a sheet (11) located near the picking device.

20. An apparatus according to claim 19, wherein the sensor is arranged to output a sensor signal to said picking device and said picking device is accelerated from a standstill to the desired picking speed in accordance with signal said sensor.

21. An apparatus according to claim 1, including a retaining device which is pivoted for rotational movement so that the distance between the retaining device and the picking device varies upon rotation of the retaining device (90–95).

22. An apparatus according to claim 1 including a sensor in the input pocket arranged to sense the presence of a sheet material.

23. An apparatus according to claim 22 wherein the sensor is arranged to output a sensor signal to a drive of the picking device and said drive of the picking device being controlled in accordance with the signal of said sensor.

24. An apparatus according to claim 22 wherein the sensor is arranged to output a sensor signal to a drive of the feed device and said drive of the feed device being controlled in accordance with the signal of said sensor.

* * * * *